United States Patent [19]

Smith et al.

[11] 4,433,337

[45] Feb. 21, 1984

[54] PASSIVE STABILIZATION CONVERSION UNIT

[75] Inventors: Dorsey T. Smith; Albert H. Bieser, both of Garland; Warren H. Kintzinger, Richardson, all of Tex.

[73] Assignee: Tracor BEI, Inc., Garland, Tex.

[21] Appl. No.: 171,247

[22] Filed: Jul. 22, 1980

[51] Int. Cl.[3] ..... H01Q 1/18

[52] U.S. Cl. ..... 343/765; 343/766; 343/709

[58] Field of Search ..... 343/763, 766, 765, 706, 343/709, 758, 760

[56] References Cited

U.S. PATENT DOCUMENTS

| | | | |
|---|---|---|---|
| 2,700,106 | 1/1955 | Taylor | 343/765 |
| 2,893,002 | 6/1959 | Ross | 343/765 |
| 2,924,824 | 2/1960 | Lanctot et al. | 343/765 |
| 3,893,123 | 7/1975 | Bieser | 343/706 |
| 4,020,491 | 4/1977 | Bieser et al. | 343/765 |

*Primary Examiner*—David K. Moore

*Attorney, Agent, or Firm*—Arnold, White & Durkee

[57] ABSTRACT

An interconnect system from a combination gyro and pendulum weight passive stabilization system unit and an equipment platform, such as an antenna platform, whereby the platform is position stabilized in pitch and roll as controlled by the passive stabilization system unit. The interconnect system may take the form of a selsyn system used with a generator and a motor interconnected by multiple wire circuitry to permit location of a passive stabilization system unit at an ideal location in an ocean-going ship, such as in the epicenter region of the ship, with minimized pitch and roll acceleration forces, and with the antenna platform stabilized thereby ideally located for antenna purposes as much as hundreds of feet away from the passive stabilization system unit.

18 Claims, 6 Drawing Figures

PASSIVE STABILIZATION CONVERSION UNIT

Figure 1:
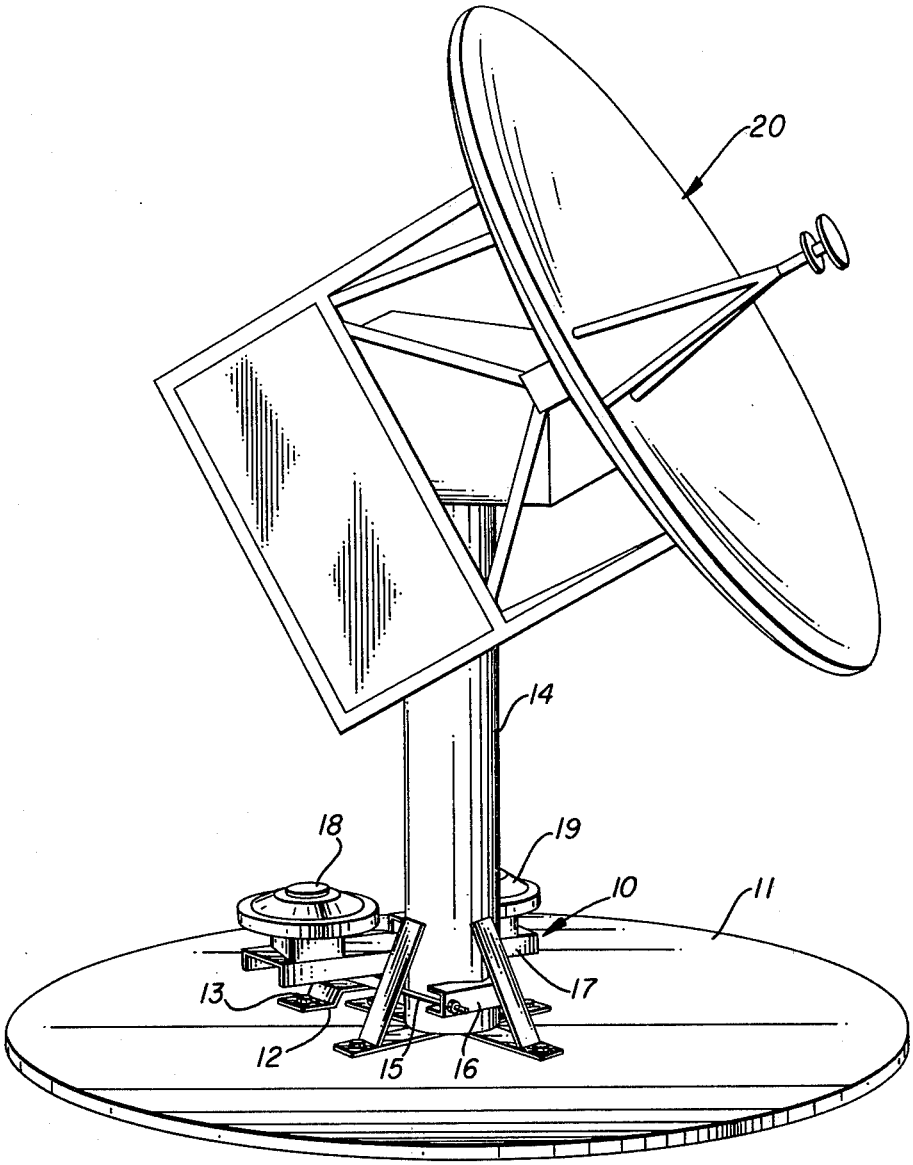

This invention relates in general to stabilized platform systems, and in particular, to interconnection of a combination gyro and pendulum weight passive stabilization system unit and an equipment platform such as an antenna platform. Combination gyro and pendulum weight passive stabilization system units useable in the systems presented could use features presented in U.S. Pat. Nos. 4,020,491 and 3,893,123 that are assigned to B. F. Industries, Garland, Tex.

Satellite communication ship terminals require stabilized antenna systems to maintain microwave transmission paths even in the presence of large ship motions. Antenna platform stabilization has been accomplished to various success levels in a variety of ways including feedback control methods with the various approaches generally quite expensive and requiring expensive field service and maintenance. The relatively recent move toward passive stabilization systems for antennas is attracting wide attention and winning favor in many circles. The additional contributions presented herein should greatly enhance the acceptance of passive stabilization for platforms such as antenna platforms in high movement environment installations, such as an shipboard and offshore platforms used for underwater oil and gas wells. Provision of an economical field installed passive stabilization conversion system would receive wide acceptance particularly if it increases communications service availability, reduce service requirements, and decrease maintenance and spare parts costs. Such advantages are obtainable through installation of passive stabilization conversion system units on satellite antenna pedestals or partially thereon and partially elsewhere on shipboard with appropriate interconnect therebetween. Installation of some of the embodiments presented herein may be accomplished with existing satellite antenna pedestals without requiring factory rework, precision machining, or even major pedestal disassembly. Proper interconnect between a dynamically balanced gimbal mounted antenna and a stabilization unit acting as a stabilization input to each of two precession axes oriented 90° to each other through an appropriate interconnect enables reductions in antenna weight, equipment complexity and cost, along with increased reliability.

It is therefore a principal object of this invention to provide an improved passive platform stabilization system with interconnect to two precession axes of a platform from a combination gyro and pendulum weight passive stabilization system installation.

Another object is for such a passive platform stabilization system to compensate pitch and roll about a two-pivotal axes on shipboard.

A further object is to provide a passive stabilization system for shipboard antennas where the antenna may be located at an optimal position on the ship for an antenna and sensing portions along with the control sources of the passive stabilization system being located optimally on shipboard for improved performance.

Features of the invention useful in accomplishing the above objects include, in a passive stabilization conversion system for stabilized platforms on shipboard, an interconnect system from a combination gyro and pendulum weight passive stabilization system unit and an equipment platform such as an antenna platform whereby the platform is position stabilized in pitch and roll as controlled by the passive stabilization unit. In some embodiments the interconnect system takes the form of a selsyn system used for each of the roll and pitch right angle axis with a generator and a motor for each axis interconnected by multiple wire circuitry or a rotary transformer or synchro system. This permits location of passive stabilization system components at an ideal location in an ocean going ship, such as in the epicenter region of the ship, with minimized pitch and roll acceleration forces or respectively on or close to roll and pitch center axis of the ship. The antenna platform stabilized thereby may then be located ideally for antenna purposes as much as hundreds of feet away from the passive stabilization system components.

Specific embodiments representing what are presently regarded as the best modes of carrying out the invention are illustrated in the accompanying drawings.

Figure 2:
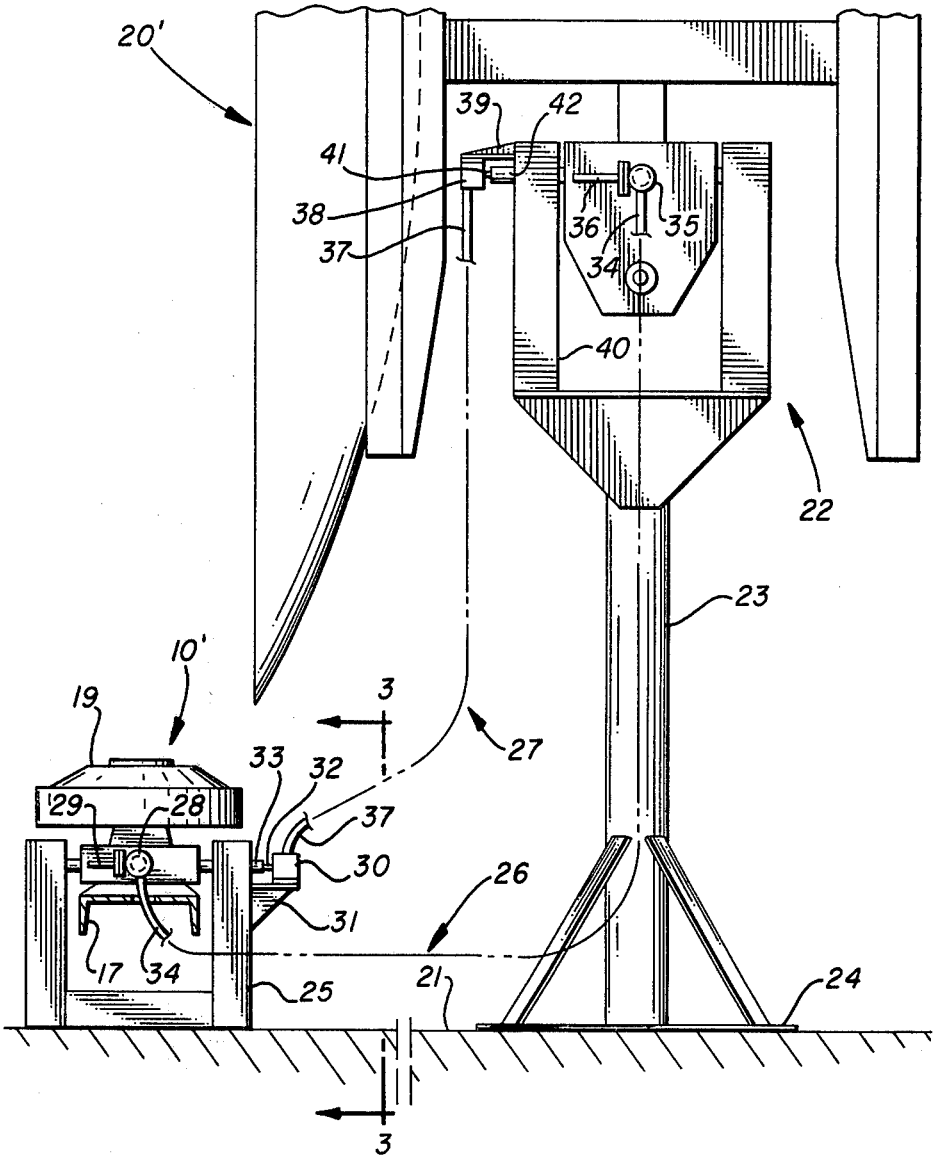
Figure 3:
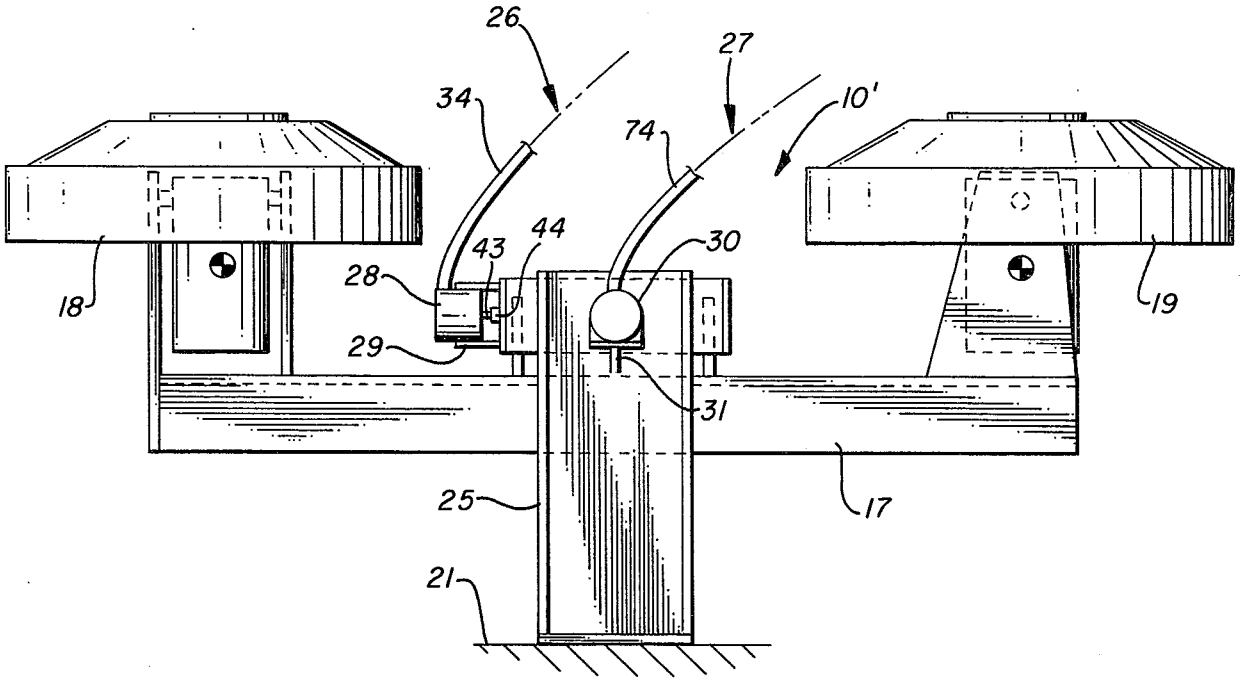
Figure 4:
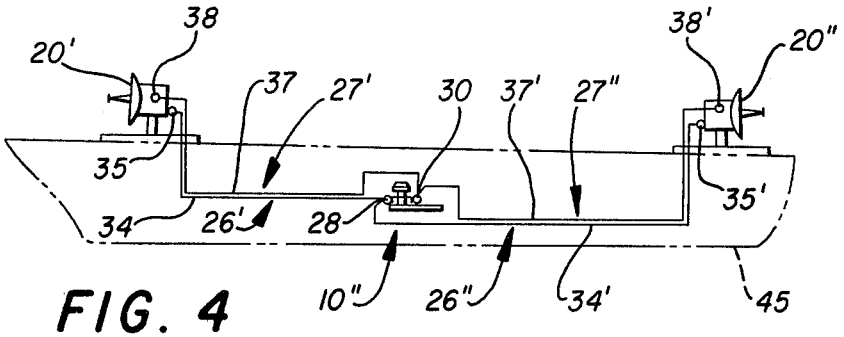
Figure 5:
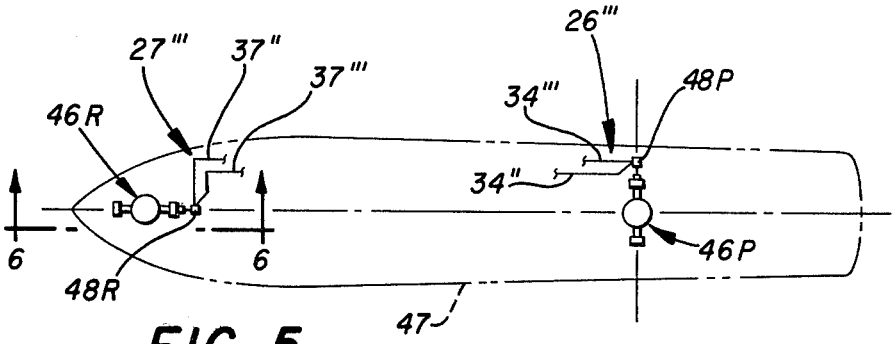
Figure 6:
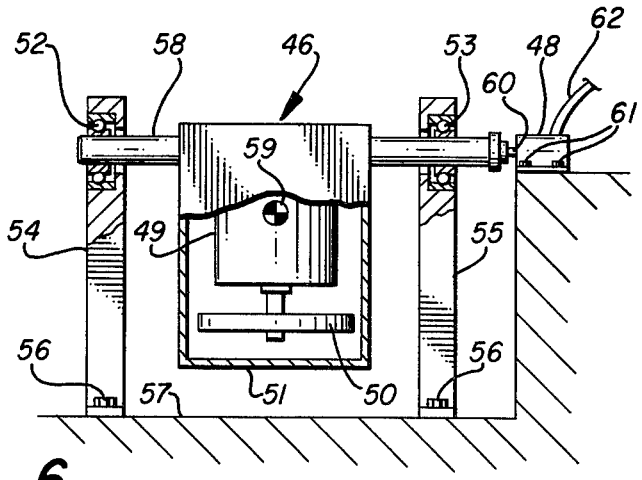

In the drawings:

FIG. 1 represents a partial perspective of a passive stabilization conversion unit equipped antenna and antenna pedestal system using a selsyn system with two sets of generators and motors, each set interconnected by cable interconnect roll and pitch linkages to an antenna platform;

FIG. 2, a partial side elevation of an alternate passive stabilization conversion unit using a selsyn system with two sets of generators and motors, each set interconnected by cables;

FIG. 3, a combination gyro and pendulum weight passive stabilization conversion sending unit as seen from line 3—3 of FIG. 2;

FIG. 4, a side elevation of a ship in phantom with a two axes selsyn drive system with a sending location in the epicenter of the ship connected for stabilizing two antenna platforms at different shipboard locations;

FIG. 5, a plan view of a ship in phantom with the passive gravity and gyro units with associated selsyn generators separated into two disassociated roll and pitch units positioned at different locations on shipboard; and, FIG. 6, a partially broken away and sectioned view of a roll passive gravity and gyro unit with its associated selsyn system sender generator taken from line 6—6 of FIG. 5.

Referring to the drawings:

A combination gyro and pendulum weight passive stabilization system unit 10 of FIG. 1 is mounted to a deck platform base 11 as by frame member 12 and bolts 13 and anchored to pedestal 14 by the bolt 15 and the bolt plate 16. The passive stabilization system unit 10 has a plate 17 mounting pitch and roll combination gyro and pendulum weight passive stabilization gyro combinations, 18 and 19, respectively, with the plate 17 itself mounted for articulating gimbaled movement about a two axes universal joint. A platform and/or antenna 20 are stabilized through interconnect with stabilizer unit 10. Anchoring of a stabilization unit 10 to pedestal 14 is more significant if mechanical interconnect is used as the stabilizing interconnect between a stabilizer unit 10 and a platform and/or antenna 20 to be stabilized thereby. While passive stabilization conversion units such as the stabilizer unit 10 of FIG. 1 provide stabilization for a platform and/or antenna 20 if mechanical interconnect rods (not shown) were employed there would be some measure of cross coupling between roll and pitch movement transmitted between the mechanical interconnect rods leading to undesired stabilization error.

Referring also to FIGS. 2 and 3, an electric signal interconnect system is employed for interconnection of the stabilizer unit 10' with antenna 20'. This not only eliminates cross coupling between roll and pitch movement such as that is transmitted between mechanical interconnect rods used with a mechanical interconnect system but permits placement of the stabilizer unit 10' at a convenient location on the deck 21 or in the bowels of a ship, as shown in FIG. 4.

With the embodiment of FIGS. 2 and 3 the gimbal mounted combination gyro and pendulum weight passive stabilization system unit 10' is much like the unit 10 of FIG. 1. Antenna 20' is the same in many respects as the antenna 20 of FIG. 1 and is also dynamically balanced about its gimbal mounting 22 on antenna pedestal 23 mounted with base 24 on deck 21. Passive stabilization system unit 10' is gimbal mounted in a base 25 mounted on deck 21 with the passive stabilization conversion system interconnect system to antenna gimbal 51' mounting inherently by its nature having decoupling from pitch and roll axis interaction. In this instance the decoupling between the pitch and roll axis in the interconnect system drive control is complete in that each has an independent selsyn system 26 for pitch and 27 for roll. Generally a selsyn system by classical well known definition comprises a generator and a motor connected by a multiple wire circuit of appreciable length, transmitting currents that turn the motor simultaneously to the same relative position as existing or established for the generator and repeating instrument indication and valve settings or other settings remotely. Any number of various rotary transformer or existing synchro systems could be used in place of a selsyn system. In any event, the pitch selsyn system 26 has a generator 28 mounted by bracket 29 in the gimbal mounting system of unit 10' such as to have its rotary input shaft connected to the gimbal rotary pitch shaft much the same as the roll selsyn system 27 has a generator 30 mounted by bracket 31 to have its rotary input shaft 32 connected to the gimbal rotary roll shaft 33. The multiple wire circuit bundle 34 of pitch selsyn system 26 extends from generator 28 to receiver motor 35 that is mounted by bracket 36 in the antenna gimbal mounting 22. The pitch receiver is mounted such that its output shaft drives the gimbal rotary pitch axis shaft in position stabilization movements relative to the motor 35 housing and the bracket 36 mounting. The multiple wire circuit bundle 37 of roll selsyn system 27 extends from generator 30 to receiver motor 38 that is mounted by bracket 39 on a gimbal mounting fixed position extension 40 of antenna pedestal 23. The roll receiver is mounted such that its output shaft 41 drives the gimbal rotary roll axis shaft 42. With the gimbal mounted combination gyro and pendulum weight passive stabilization system unit 10' of FIGS. 2 and 3 roll and pitch selsyn system generators 30 and 28, respectively, have rotary input shafts 32 and 43 that rotate with rotation of respective gimbal related shafts 33 and 44 on which they are respectively fixed.

With passive stabilization conversion systems such as the embodiment of FIG. 2 using transmitter-receiver pairs, generator receiver, various synchro systems where sending units are connected to receiver following units by wire interconnect, fiber optic signal interconnect, or signal beam interconnect laser light or electromagnetic signals transmission elsewhere in the spectrum available, many options are available for both stabilized antenna and/or equipment stabilized platform placement and sending unit placement. A typical showing of equipment placement flexibility is presented in FIG. 4 where a gimbal mounted combination gyro and pendulum weight passive stabilization system unit 10" is located in the epicenter region of a ship 45 in a location of minimized pitch and roll and also heaving acceleration forces. Such an epicenter region location in a ship can be environmentally much more protective than out at or near an antenna 20' pedestal location or at a stabilized equipment pedestal. Pitch selsyn system 26' has cable 34 interconnect over considerable distance from unit 10" pitch generator 28 to pitch receiver motor 35 on antenna 20' that is located at desired optimal location on shipboard for an antenna itself. The roll selsyn system 27' also has, in like manner, a cable 37 interconnect over considerable distance from unit 10" roll generator 30 to roll receiver motor 38 on antenna 20'.

A very significant expansion of antenna system installation versatility with such passive stabilization control is that more than one antenna and/or stabilized platform at a number of shipboard locations may be subject to passive stabilization control from one combination gyro and pendulum weight passive stabilization system unit 10" over distances as much as hundreds of feet from the unit 10". In FIG. 4 an additional antenna 20" is shown as being stabilization controlled from unit 10" with pitch selsyn system 26" having a cable 34' interconnect from the unit 10" pitch generator 28 to pitch receiver motor 35' on antenna 50". The roll selsyn system 27" has a cable 37' interconnect from unit 10" roll generator 30 to roll receiver motor 38' on antenna 20".

Referring to FIGS. 5 and 6, it should be noted that a further degree of passive stabilization control flexibility for stabilized antennas and/or platforms is made possible through use of selsyn systems, or their functional equivalent, in that the two gyro sub-unit combination gyro and pendulum weight passive stabilization system units such as units 10" may be split into two independent sub-units, one a pitch single gyro and pendulum weight passive stabilization system unit 46P and the other a roll single gyro and pendulum weight passive stabilization system unit 46R that are substantially identical. The only difference with respect to the pitch and roll units 46P and 46R is that the pitch unit 46P is mounted with its pivotal mounting axis on the pitch axis of the ship 47, or displaced therefrom, but parallel to the transverse oriented pitch axis of the ship, and the pivotal mounting axis of the roll unit 46R is on the longitudinal bow to stern axis of the ship, or displaced laterally therefrom but in any event parallel to the ship's longitudinal axis. A single gyro combination and pendulum weight passive stabilization system unit 46 becomes a pitch unit 46P, or a roll unit 46R, by mounting and the selsyn sender generator 48 used therewith. A pitch unit selsyn sender generator 48P feeds a pitch selsyn system 26''' cable 34" such as the cable 34 to antenna 20' in FIG. 4, and if desired, also feeds a pitch selsyn system cable 34''' such as the cable 34' to antenna 20" in FIG. 4. The roll unit selsyn generator 48R feeds a roll selsyn system 27''' cable 37" such as the cable 34 to antenna 50' in FIG. 4, and if desired, also feeds a roll selsyn system cable 37''' such as the cable 37' to antenna 20" in FIG. 4. The single gyro combination and pendulum weight passive stabilization system unit 46 is a single gyro motor 49 and gyro wheel 50 combination enclosed within a protective enclosure 51 pivotally mounted on bearing 52 and 53 equipped mount stanchions 54 and 55, respectively, bolted 56 to fixed structure 57 of a ship, or other vehicle or offshore platform. The pivot shaft 58 mounting of the single gyro motor 49, the gyro wheel 50 and the enclosure 51 as an assembly have a center of gravity 59 located below the pivot shaft 58 pivotal mounting thereof so as to give pendulum weight passive stabilization effect desired coupled with the gyro action in the unit. The input shaft 60 of selsyn sender generator 48 that is mounted on fixed structure 57 as by bolts 61 is connected for rotation with the pivot shaft 58. The output cable bundle 62 is the bundle as numbered for pitch and roll systems shown in FIG. 5 as determined by respective 46P and 46R unit 46 mountings.

Please note again that the pitch and roll axis of combination gyro and pendulum weight stabilization system units in various of the passive stabilization conversion units presented may be interchanged by shifting the orientation of stabilization system passive stabilization system sending unit mountings on shipboard and corresponding stabilized antenna and/or stabilized platform orientation. There may be a canting of the orientation to between the pitch and roll axis of ship just so long as the two axis are displaced substantially ninety degrees from each other and the orientation of the sending units and stabilized antenna, and/or stabilized platforms individually and/or in plurality thereof are in duplicate orientation. While there is distinction in field of gyroscopes that gyros are defined as such with gyro wheel speeds above a certain speed of some 20,000 rpm and those below as flywheel assemblies, but even what are identified as gyros herein have wheels that may turn as low as approximately 1500 rpm, they are being used in gyro sense from a classical physics sense and therefore identified as such throughout this specification. It should be noted further, that the passive stabilized antennas presented herewith are equipped with tracking control systems of a conventional nature (not shown).

Whereas this invention has been described with respect to several embodiments thereof, it should be realized that various changes may be made without departing from the essential contributions to the art made by the teachings hereof.

We claim:

1. In a combination gyro and pendulum weight passive stabilization sending conversion interconnect and stabilized receiving structure system: combination dual axis gyro and pendulum weight passive stabilization sending means; a dynamically balanced dual axis gimbal mounted stabilized receiving unit physically mountable separately and remotely from the sending means; dual axis conversion interconnect structure; with first electrically actuatable interconnect means electrically connected between a first axis of the dual axis of said gyro and pendulum weight passive stabilization sending means and the corresponding first axis of said stabilized receiving unit, and with second electrically actuatable interconnect means electrically connected between a second axis of the dual axis of said gyro and pendulum weight passive stabilization sending means and the corresponding second axis of said stabilized receiving unit; with electrically actuatable decoupling means for electrically decoupling said first interconnect means and said second interconnect means; and wherein each said first and second independent interconnect means includes motion to signal translation means; signal transmission means; and signal to motion translation means.

2. In a combination gyro and pendulum weight passive stabilization sending conversion interconnect and stabilized receiving structure system: combination dual axis gyro and pendulum weight passive stabilization sending means; a dynamically balanced dual axis gimbal mounted stabilized receiving unit physically mountable separately and remotely from the sending means; dual axis conversion interconnect structure; with first electrically actuatable interconnect means electrically connected between a first axis of the dual axis of said gyro and pendulum weight passive stabilization sending means and the corresponding first axis of said stabilized receiving unit, and with second electrically actuatable interconnect means electrically connected between a second axis of the dual axis of said gyro and pendulum weight passive stabilization sending means and the corresponding second axis of said stabilized receiving unit; and with electrically actuatable decoupling structure means for electrically decoupling said first interconnect means and said second interconnect means.

3. The passive stabilization sending to receiving stabilized structure of claim 2, wherein said combination balanced dual axis gyro and pendulum weight stabilization sending means includes pivotal structure means pivotally mounted separately and remotely from the mounting location of the receiving unit and with respect to one or more pivotal axes and having a center of gravity below said pivotal axes; gyro motor means and rotor means associated with at least one of said pivotal axes and pivotally mounted by pivot means in said pivotal structure means.

4. The passive stabilization sending to receiving stabilized structure of claim 3, wherein said dual axis conversion interconnect structure first and second interconnect means each include, first and second motion translating means connected, respectively, to rotary means individually of said first and second axis of the dual axes of said gyro and pendulum weight passive stabilization sending unit means; third and fourth motion translating means connected, respectively, to pivotal axis means of each of said dual axes of said dual axes gimbal mounted stabilized receiving unit; and first and second motion interconnect translating means interconnecting said first and second motion translating means with, respectively, said third and fourth motion translating means.

5. The passive stabilization sending to receiving stabilized structure of claim 4, wherein said combination dual axis gyro and pendulum weight stabilization sending means includes a dual axes gimbal mounting with pivotal means of each of said dual axis connected, respectively, to said first and second interconnect means.

6. The passive stabilization sending to receiving stabilized structure of claim 5, wherein said combination dual axis gyro and pendulum weight stabilization sending means is a one gyro unit with a center of gravity below the level of dual axes of the gimbal mounting thereof.

7. The passive stabilization sending to receiving stabilized structure of claim 6, wherein aid combination dual axes gyro and pendulum weight stabilization sending means is a two gyro unit with the two gyros on a dual axes gimbal mounted platform; with each gyro unit mounted to pivot about a respective one of right angle pivotal gyro mountings on said platform; and with each gyro unit with a center of gravity below the level of its pivotal gyro mounting on said platform.

8. The passive stabilization sending to receiving stabilized structure of claim 4, wherein said first and second interconnect means are decoupled in being independent inerconnect systems connecting respective right angle axis of said stabilized sending means to right angle axis of said balanced dual axes gimbal mounted stabilized receiving unit with connections of said interconnect systems to rotary elements of respective right angle axis without cross coupling of movement of one axis interconnect system to the other axis interconnect system.

9. The passive stabilization sending to receiving stabilized structure of claim 8, wherein each said first and second independent interconnect systems includes, motion to signal translation means; signal transmission means; and signal to motion translation means.

10. The passive stabilizatin sending to receiving stabilized structure of claim 9, wherein with each of said independent interconnect systems said motion to signal translator is a motion to electrical signal translator input connected to rotory means of one axis of said stabilized sending means; said signal to motion translator means is an electrical signal to motion translator output connected to rotary means of one axis of said stabilized receiving means; and said signal transmission means is electric cable interconnect means interconnecting said motion to electrical signal translater with said electrical signal to motion translator; and with each independent interconnect system interconnecting a pivotal axis of said sending unit to a substantially parallel axis of said receiving unit.

11. The passive stabilization sending to receiving stabilized structure of claim 10 wherein each independent interconnect system is a selsyn system with a generator sender carried by said sending means and a motor receiver carried by said receiving unit interconnected by multiple wire circuit cable means.

12. the passive stabilization sending to receiving stabilized structure of claim 9 wherein said passive stabilization sending means is located at an ideal location in an ocean-going ship and the stabilized receiving means is an equipment carry platform stabilized thereby ideally located for optimized operation of equipment on the platform.

13. The passive stabilization sending to receiving stabilized structure of claim 12, wherein a plurality of stabilized receiving means are connected to receive stabilization control from a common stabilization sending means.

14. The passive stabilization sending to receiving stabilized structure of claim 13, wherein the common stabilization sending means is located in epicenter region of a ship with minimized pitch and roll acceleration forces.

15. The passive stabilization sending to receiving stabilized structure of claim 14, wherein said stabilized receiving means are plurality of stabilized antenna mounts that are located on shipboard at locations ideally suited for antenna purposes.

16. The passive stabilization sending to receiving stabilized structure of claim 9, wherein said passive stabilization sending means is two single rotational axis mounted gyro units each having a center of gravity below the pivotal mounting thereof; and with the single rotational axis gyro units mounted with their rotation mounting axis being oriented substantially at right angles to each other.

17. the passive stabilization sending to receiving stabilized structure of claim 16, with the single rotational axis of one of said gyro units parallel to the longitudinal bow to stern roll axis of a ship; and the rotational axis of the other of said gyro units parallel to the pitch axis of the ship.

18. the passive stabilization sending to receiving stabilized structure of claim 17, with the single rotational axis of one of said gyro units substantially coexistent with the bow to stern roll axis of the ship; and with the rotational axis of the other of said gyro units parallel to the pitch axis in the region of the pitch axis of the ship.

* * * * *

UNITED STATES PATENT AND TRADEMARK OFFICE

CERTIFICATE OF CORRECTION

PATENT NO. : 4,433,337

DATED : February 21, 1984

INVENTOR(S) : Dorsey T. Smith, Albert H. Bieser, Warren H. Kintzinger

It is certified that error appears in the above-identified patent and that said Letters Patent is hereby corrected as shown below:

Column 1, line 12, change "F. Industries" to -- E. Industries --; line 26, change "an" to -- on --.

Column 6, line 55, change "aid" to -- said --.

Column 8, line 26, change "the" to -- The --; line 32, change "the" to -- The --.

Signed and Sealed this

*Twelfth* Day of *June 1984*

[SEAL]

*Attest:*

GERALD J. MOSSINGHOFF

*Attesting Officer*

*Commissioner of Patents and Trademarks*